US007624527B2

(12) United States Patent
Casas Salva

(10) Patent No.: US 7,624,527 B2
(45) Date of Patent: Dec. 1, 2009

(54) SIGHT FOR SPORTING RIFLES

(75) Inventor: Francisco Casas Salva, Sant Boi de Llobregat (ES)

(73) Assignee: Industrias el Gamo, S.A., Sant Boi de Llobregat, Barcelona (ES)

( * ) Notice: Subject to any disclaimer, the term of this patent is extended or adjusted under 35 U.S.C. 154(b) by 0 days.

(21) Appl. No.: 11/663,654

(22) PCT Filed: Sep. 22, 2005

(86) PCT No.: PCT/ES2005/000515

§ 371 (c)(1),
(2), (4) Date: Apr. 1, 2008

(87) PCT Pub. No.: WO2006/035096

PCT Pub. Date: Apr. 6, 2006

(65) Prior Publication Data

US 2008/0256837 A1 Oct. 23, 2008

(30) Foreign Application Priority Data

Sep. 24, 2004 (ES) ..... 200402187 U

(51) Int. Cl.
*F41G 1/02* (2006.01)

(52) U.S. Cl. ..... 42/111

(58) Field of Classification Search ..... 42/111
See application file for complete search history.

(56) References Cited

U.S. PATENT DOCUMENTS 2,239,231 A * 4/1941 Hooks ..... 42/148
2,377,704 A * 6/1945 Loomis ..... 42/139
3,365,829 A * 1/1968 Shockey ..... 42/97
3,648,374 A 3/1972 Lewis
3,840,995 A * 10/1974 Freiling ..... 42/148
3,945,142 A 3/1976 Keppeler
4,008,536 A * 2/1977 Adams ..... 42/112
5,878,503 A * 3/1999 Howe et al. ..... 42/132
6,421,946 B1 * 7/2002 LoRocco ..... 42/111
2002/0166278 A1 * 11/2002 Carlson ..... 42/132
2007/0180752 A1 * 8/2007 Houde-Walter ..... 42/114

FOREIGN PATENT DOCUMENTS

ES 8704000 5/1987

* cited by examiner

*Primary Examiner*—Michael Carone
*Assistant Examiner*—Reginald Tillman, Jr.
(74) *Attorney, Agent, or Firm*—Townsend and Townsend and Crew LLP

(57) ABSTRACT

The invention relates to a sight for sporting rifles. The inventive sight consists of: a support (5) comprising a body which surrounds part of the barrel and a head which covers part of the muzzle and which is equipped with a sufficient opening for the through passage of the bullet once fired, the diameter of said head being greater than that of the muzzle; first sliding guides on the outer surface of the aforementioned support (5), which are mounted to first guide elements located on the inner surface of the large muzzle (3); a sliding base (9) for fixing the front sight; second sliding guides on the outer surface of the sliding base (9), which are mounted to second guide elements located on the upper outer part of the support (5); and connecting means which are provided on the sliding base (9) in order to fix a front sight.

8 Claims, 5 Drawing Sheets

SIGHT FOR SPORTING RIFLES

A sight for sporting rifles, of the type that is located near the mouth of the barrel, with a muzzle wrapped around the barrel, at least partially and a lower thickening for fitting an accessory that is characterised in that it also comprises a support, comprising a body which surrounds part of the barrel and a head that covers part of the cited mouth, having a diameter greater than the referred mouth, with a sufficient aperture to allow a projectile pass through once fired, together with first sliding guides on the outer surface of the mentioned support, and that are ensambled on same guiding elements located in the muzzle interior surface, a sliding base for securing the front sight, second sliding guides on the outer surface of the sliding base that are mounted on second guide elements located on the upper outer section of the support and union means on the sliding base for securing a front sight.

BACKGROUND OF THE INVENTION

Various sights are known in the state of the art for sporting rifles that are mounted on far end of the rifle barrel.

Thus, Spanish Patent No 545999 (ES8704000) is known from the Brazilian firm FORJAS TAURUS, S. A. (1985) that refers to a sighting system adapted for use with competition revolvers that allow various wide adjustments to be made, basically comprising a thick steel rib that can be introduced on the upper part of the firearm barrel and of the frame, the rib is fitted with a notch with a dovetail section, along the full length of the lower face, along which the remaining system components can be inserted, moved and fixed in place. The components are: the rear sight, which is micrometrically adjustable with respect to height, the direction and the respective notch opening, the front sight, the insertion parts of which are interchangeable with several width options and include one with side in a lateral contrasting in colour and, lastly an auxiliary weight.

Spanish Utility Model No 9501271 (ES1031774) of Mr Francisco Barba Trigueros of 1995 is known within this same idea of employing a bar or rib on which to secure the sight. FIG. 1 clearly shows the use of said rib or bar to secure a sight on the front part of the barrel with screws.

BRIEF DISCLOSURE OF THE INVENTION

The present invention is a considerable advance in the sight sector because it allows its simple installation and is also fully reliable.

One of the main drawbacks of the companies that manufacture this type of rifle comprises the fact that the sight points are fixed in an unmoveable fashion, generally by screws and subsequently it is very expensive and difficult to replace a front sight.

Moreover, there is a danger of over-tightening the screws resulting in misaligned sights.

All the above mentioned has led to look for solutions to solve said problems.

One very advanced solution is pointed out in the background of the invention, specifically Spanish Patent 545999 (ES8704000), which employs a rib to allow sight movement. Despite this, the invention has several drawbacks. On the one hand, there is no sight stop so that it has to be fitted in place using screws or clamped to said rib. Moreover, the rib is a non-aesthetic element that significantly increases the weapon's weight.

Thus, in order to resolve the previously cited drawbacks, the inventor has configured the sliding base so that it is not necessary to secure it in place, because it enters via sliding guides and the installation is not forced and is, therefore, a perfect fit.

At the same time, the sporting rifle weight is not increased because the sight is manufactured using a lightweight material.

In addition, as the drawings show, it is fully integrated with the sporting rifle as a trimming element.

One main goal of this invention is a sight for sporting rifles, of the type that is located near the mouth of the barrel, with a muzzle wrapped around the barrel, at least partially and a lower thickening for fitting an accessory that is characterised in that it also comprises a support, comprising a body wrapped around part of the barrel and a head that covers part of the cited mouth, having a diameter greater than the referred mouth, with a sufficient aperture to allow a projectile pass through once fired, together with first sliding guides on the outer surface of the referred support, which are mounted on first guide elements located in the interior muzzle surface, a sliding base for securing the front sight, second sliding guides on the outer surface of the sliding base that are mounted on second guide elements located on the upper outer section of the support and union means located on the sliding base for securing a front sight.

Another goal of the present invention is a sight with the characteristics of the previous paragraph, which also incorporates a projection on the lower thickening for fitting of the loading lever arm.

A sight in accordance with referred paragraph of the main goal is also another goal of the present invention, in which the second sliding guides, when the sliding base is mounted on the support, slide along the inside of the second guide elements in the same direction as the projectile leaves the barrel after being fired.

An additional goal of the present invention is a sight in accordance with the referred paragraph of the main goal in which screws are employed to secure the support to the barrel.

Another additional goal in accordance with the previous paragraph is that screws are used to secure the muzzle to the support and to the barrel.

BRIEF DESCRIPTION OF THE DRAWINGS

In order to facilitate the description, the present report is accompanied by five sheets of drawings on which a practical exemplary embodiment case has been presented, which is provided merely as an example that does not limit the scope of the present invention.

SPECIFIC EXEMPLARY EMBODIMENT OF THE APPLIED-FOR INVENTION

Figure 1:
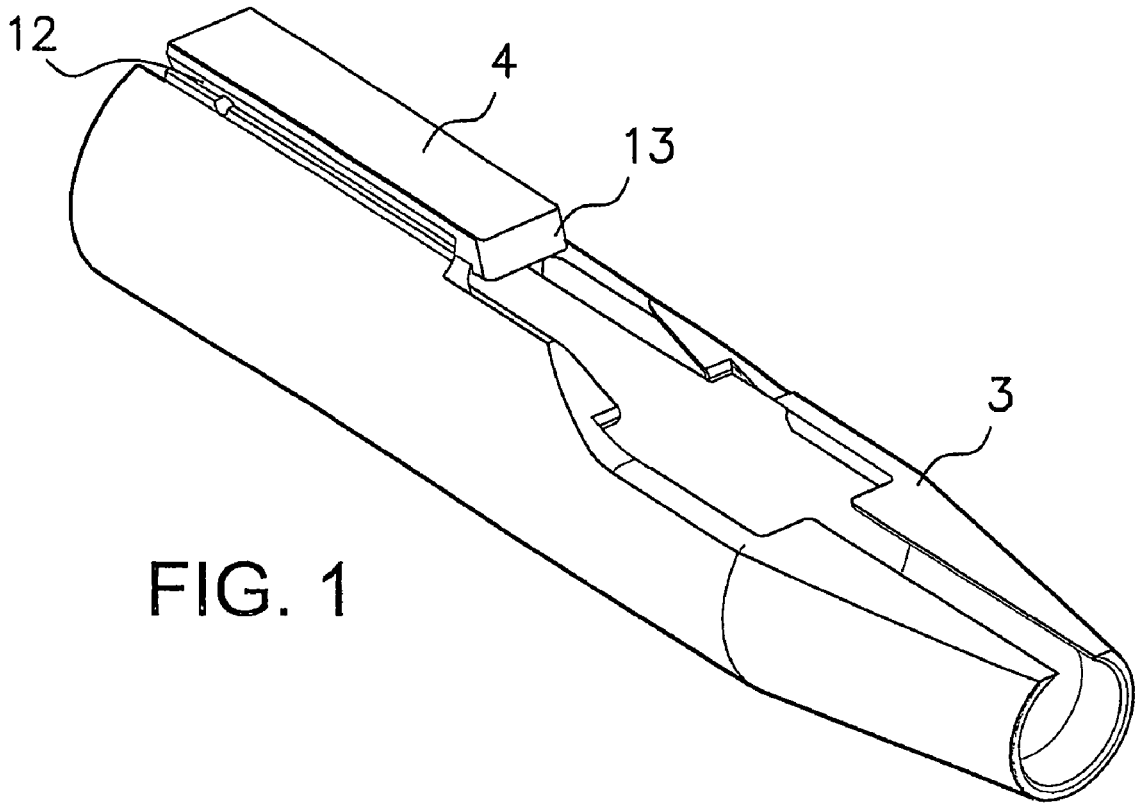
FIG. 1 is a perspective view from under the muzzle.

Thus, FIG. 1 illustrates a muzzle 3, a lower thickening 4, a projection 13 and a third guide element 12.

Figure 2:
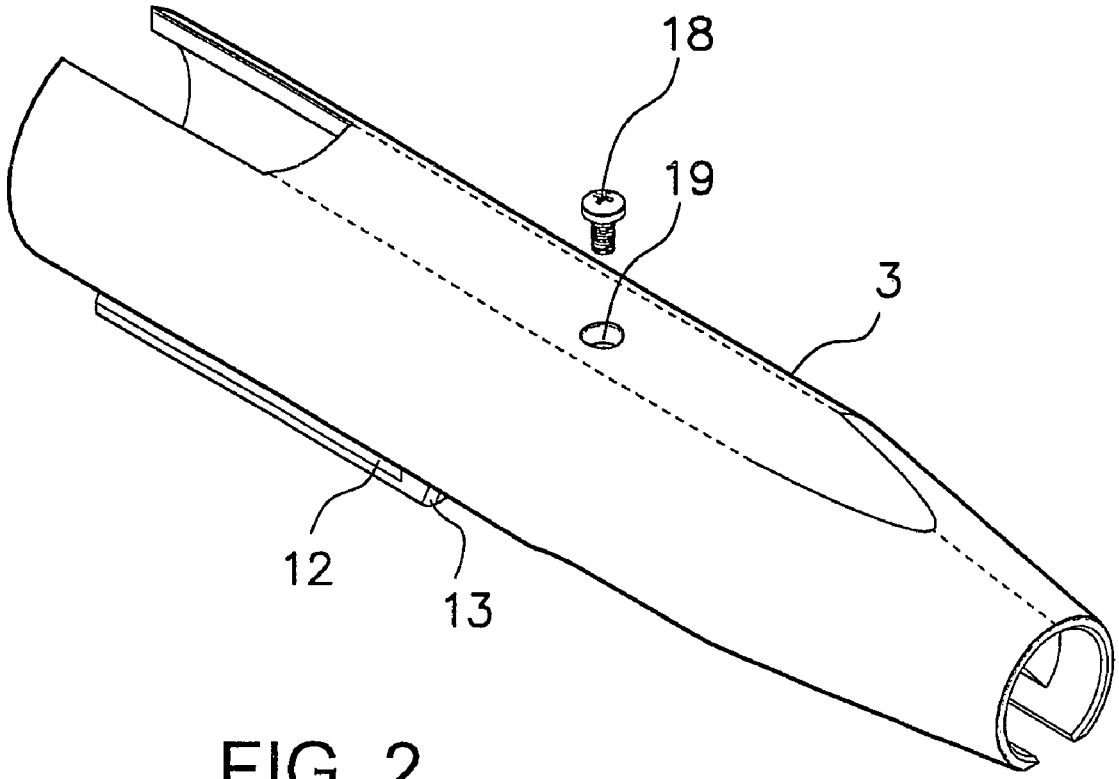
FIG. 2 is a perspective view from above the referred muzzle.

FIG. 2 shows the muzzle 3, the projection 13, a screw 18, the third guide element 12 and a hole 19.

Figure 3:
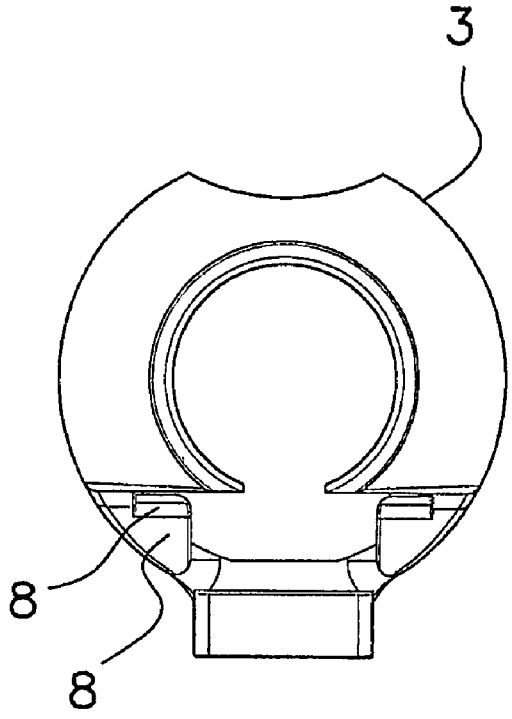
FIG. 3 is a frontal view of the muzzle from the muzzle neck.
Figure 4:
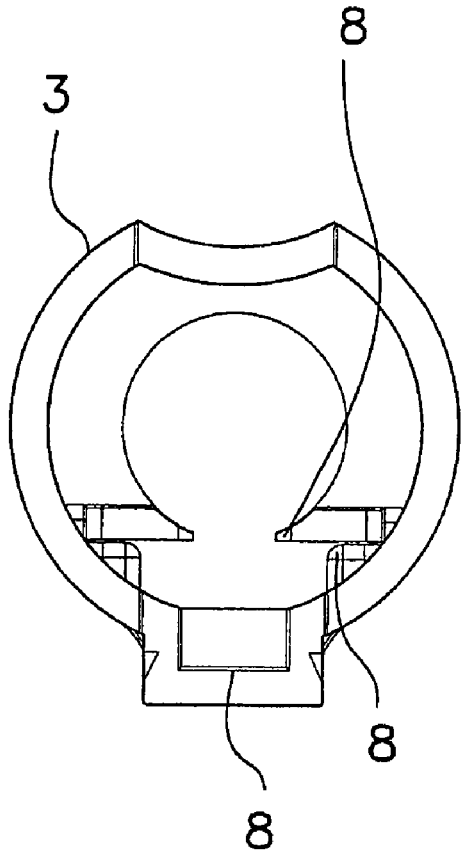
FIG. 4 is a frontal view of the muzzle from the muzzle mouth.

The muzzle 3 and first guide elements 8 are shown in FIGS. 3 and 4.

Figure 5:
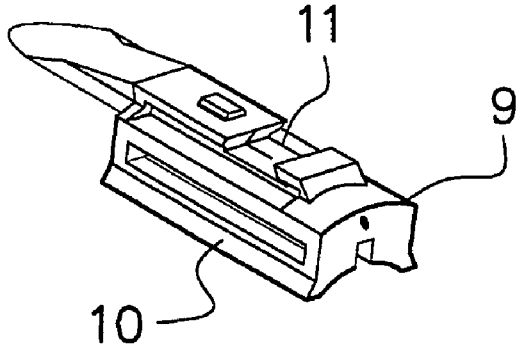
FIG. 5 is a perspective view of the sliding base.

FIG. 5 illustrates a sliding base 9, second sliding guides 10 and union means 11.

Figure 6:
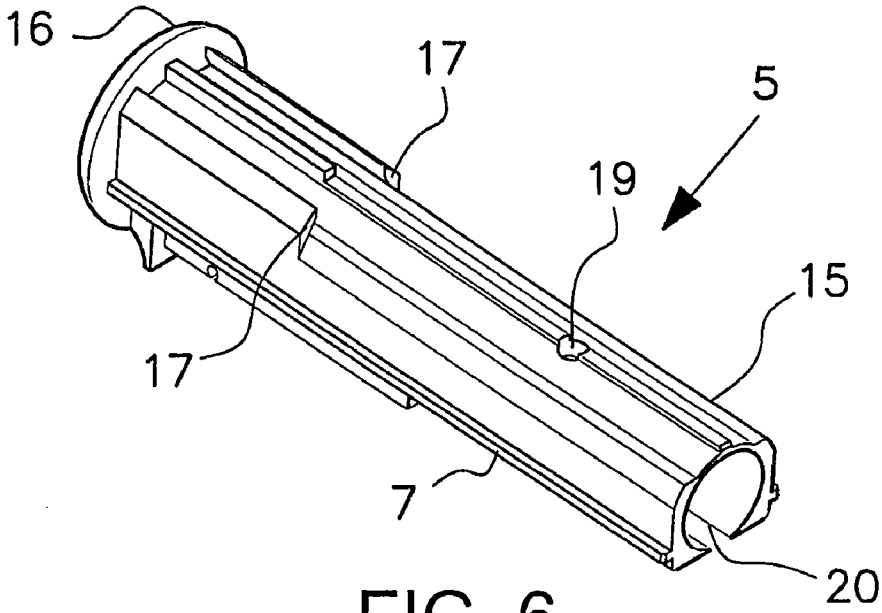
FIG. 6 is a perspective view of the support.

FIG. 6 shows a support 5, a body 15, a head 16, first sliding guides 7, a hole 19, a housing 20 and second guide elements 17.

Figure 7:
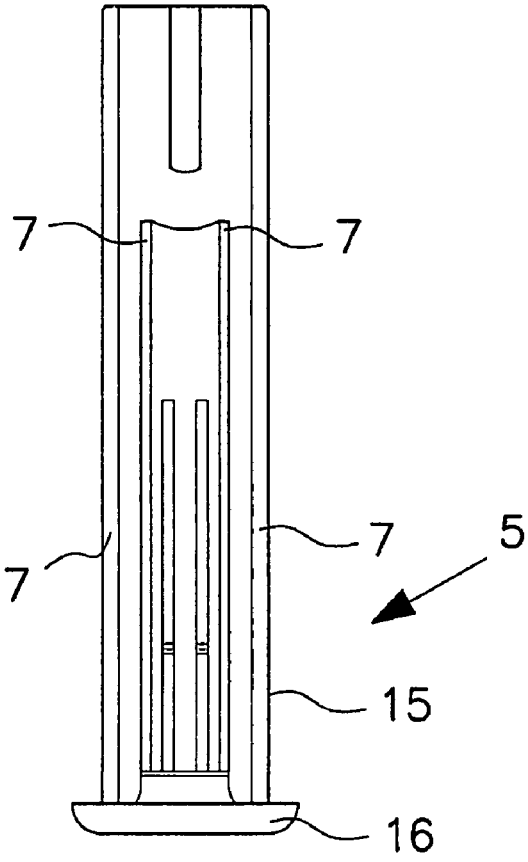
FIG. 7 is a view from under the mentioned support.

The referred support 5 is shown in FIG. 7, together with the body 15, the head 16 and first sliding guides 7.

Figure 8:
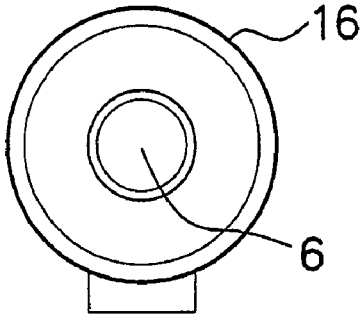
FIG. 8 is a frontal view of the support from its head.

FIG. 8 illustrates the support head 16 and an aperture 6.

Figure 9:
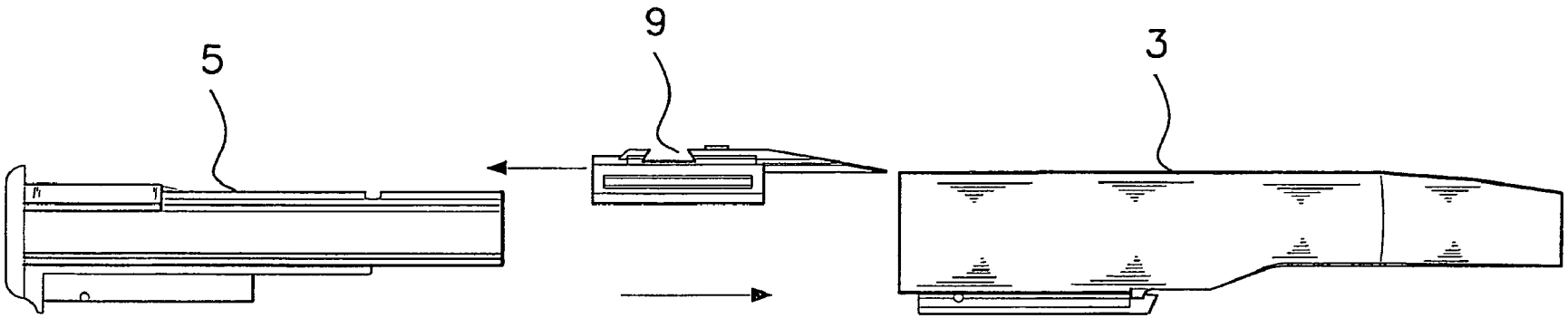
FIG. 9 is an assembly of the sliding base on the support and the second on the muzzle.

FIG. 9 shows the muzzle 3, support 5 and the sliding base 9.

Figure 10:
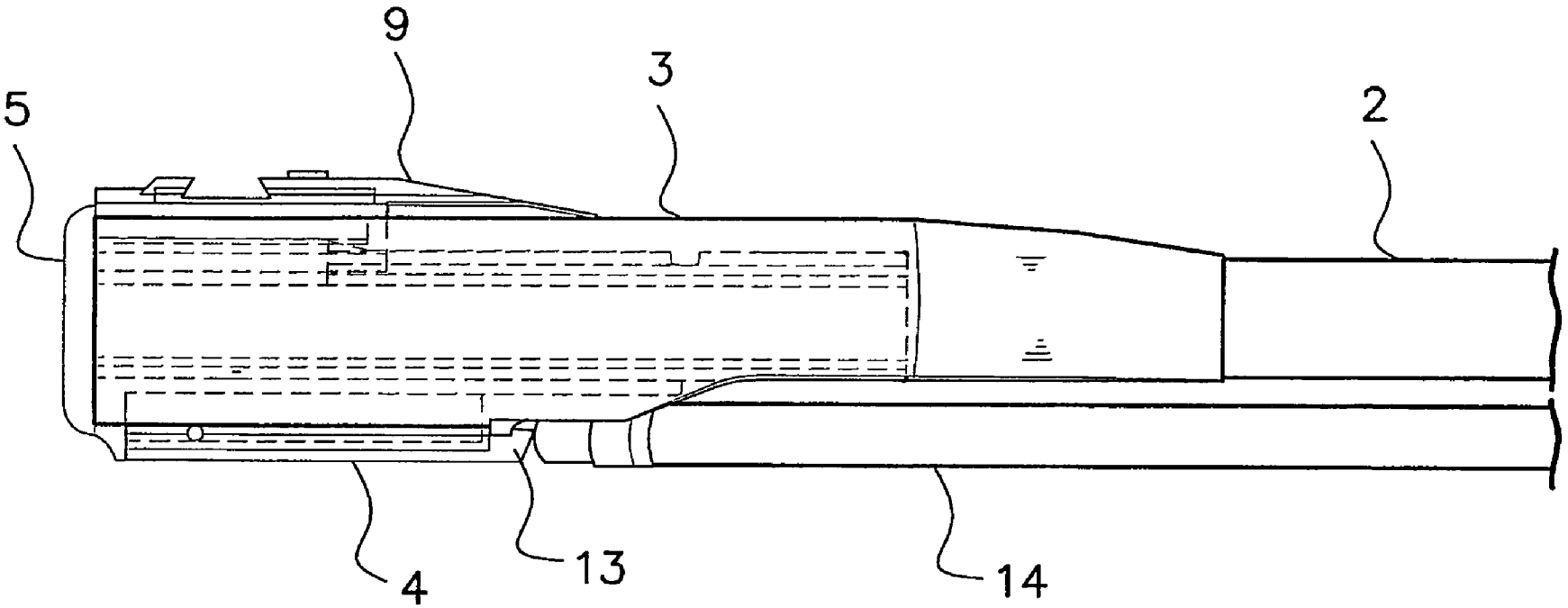
FIG. 10 is a side view of the object of the present invention, mounted on the barrel and on the rifle loading lever arm.

Finally, FIG. 10 contains the support 5, muzzle 3, sliding base 9, the lower thickening 4, the projection 13, a barrel 2 and loading lever arm 14.

In a specific exemplary embodiment, in a first phase, the muzzle 3 is introduced via the barrel mouth 2, first passing it via the muzzle neck.

The front sight (not shown on the drawings) is fitted to the union means 11 on the sliding base 9.

Then the sliding base 9 is installed on the support 5, by fitting the second sliding guides 10 into the second guide elements 17, pushing said sliding base 9 until it stops on coming into contact with the support head 16 that acts as a stop.

Subsequently, the barrel 2 is fitted to the support 5, introducing the referred barrel via the housing 20 until the mouth of the barrel 2 reaches a stop (not shown on the drawings) which is located inside said housing 20.

Lastly, the muzzle 3 is moved along the first sliding guides 7 that are positioned in the first guide elements 8 until it reaches the head 16. For enhanced security, a screw 18 inserted through the hole 19 to unite the muzzle 3 with the support 5 and the barrel 2.

In order to secure the loading lever arm 14, a projection 13 is included, located on the lower thickening 4, which pushes and acts as a retainer for the referred loading level arm 14.

The mentioned lower thickening 4 includes third guide elements 12 for the installation of, for example, a laser (not shown on the drawings).

If there was a need of a replace of the front sight, the operation would be carried out in reverse order. In other words, the muzzle 3 is pushed in the opposite direction to the projectile exit from the sporting rifle barrel 2, the barrel support 5 is removed, freeing the fitting housing 20 in the same direction as the projectile exit from the sporting rifle barrel 2. Then, the sliding base 9 is extracted from support in the direction opposite to the projectile exit from the sporting rifle barrel 2.

Finally, the front sight is released from the union means 11.

In order to improve rifle performance and avoid increasing its weight for the user, the inventor has designed the sight of the present invention to be manufactured with lightweight material, for example, plastic or polyurethane.

The present invention describes a new sight for sporting rifles. The examples mentioned here do not limit the present invention, for this reason it could have various applications and/or adaptations, all within the scope of the following claims.

To facilitate the understanding and tracking of the report, a numeric legend is provided below:

2. Barrel
3. Muzzle
4. Lower thickening
5. Support
6. Aperture
7. First sliding guides
8. First guide elements
9. Sliding base
10. Second sliding guides
11. Union means
12. Third guide elements
13. Projection
14. Loading lever arm
15. Body
16. Head
17. Second guide elements
18. Screws
19. Hole
20. Housing

The invention claimed is:

1. A sight for sporting rifles, of the type that is located close to the barrel mouth, comprising:

a muzzle which wraps around the barrel, at least partially, wherein a lower thickening for fitting an accessory is formed on a lower portion of the muzzle:

a support, comprising a body that wraps around least part of the barrel and that includes a head which covers part of the mouth, with a diameter that is greater than that of the mouth, and with an aperture of sufficient size to allow the projectile to pass through once fired wherein first sliding guides are formed on an exterior surface of the support, the first sliding guides being mounted on first guide elements located on an interior surface of the muzzle; and a sliding base for securing a sight point wherein second sliding guides are formed on an exterior surface of the sliding base, the second sliding guides being mounted on second guide elements on an exterior upper part of the support, wherein union means for securing the sight point arc formed on the sliding base.

2. A sight in accordance with claim 1, characterized in that the lower thickening includes a projection for the fining of a loading lever arm.

3. A sight in accordance with claim 1, characterized in that the second sliding guides, when the sliding base is mounted on the support, move inside the second guide elements in the same direction as a projectile would travel when it exits the barrel after being fired.

4. A sight in accordance with claim 1, further compromising at least one screw that couples the muzzle to the support and to the barrel.

5. A sight in accordance with claim 1, characterized in that it is manufactured using a lightweight material.

6. A sight in accordance with claim 2, characterized in that it is manufactured using a lightweight material.

7. A sight in accordance with claim 3, characterized in that it is manufactured using a lightweight material.

8. A sight in accordance with claim 4, characterized in that it is manufactured using a lightweight material.

* * * * *